US008162471B2

(12) United States Patent
Shin et al.

(10) Patent No.: US 8,162,471 B2
(45) Date of Patent: Apr. 24, 2012

(54) IMAGE FORMING ELEMENT AND MANUFACTURING METHOD THEREOF

(75) Inventors: Su Ho Shin, Yongin-si (KR); Kyu Ho Shin, Yongin-si (KR); Chang Youl Moon, Yongin-si (KR); Eung Yeoul Yoon, Yongin-si (KR); Jin Seung Choi, Yongin-si (KR); Ki Hwan Kwon, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 991 days.

(21) Appl. No.: 11/783,973

(22) Filed: Apr. 13, 2007

(65) Prior Publication Data

US 2008/0131175 A1 Jun. 5, 2008

(30) Foreign Application Priority Data

Dec. 1, 2006 (KR) ..... 10-2006-0120510

(51) Int. Cl.
*B41J 2/01* (2006.01)

(52) U.S. Cl. ..... 347/103; 399/313

(58) Field of Classification Search ..... 347/141, 347/158, 151, 103; 399/159, 252, 265, 289, 399/313; 430/325; 492/9, 16; 29/460, 895.2
See application file for complete search history.

(56) References Cited

U.S. PATENT DOCUMENTS 2,932,690 A * 4/1960 Adams et al. ..... 358/300
3,569,982 A * 3/1971 Shebanow et al. ..... 347/146
3,909,258 A * 9/1975 Kotz ..... 430/122.8
4,331,757 A * 5/1982 Tanaka et al. ..... 430/122.5
4,728,971 A * 3/1988 van Stiphout et al. ..... 347/141
4,733,256 A * 3/1988 Salmon ..... 347/55
4,748,464 A * 5/1988 Pannekoek et al. ..... 347/141
5,030,976 A * 7/1991 Salmon ..... 347/117
5,115,279 A * 5/1992 Nishikawa et al. ..... 399/331
5,130,751 A * 7/1992 Sato et al. ..... 399/96
5,416,569 A * 5/1995 Goldberg ..... 399/318
5,448,342 A * 9/1995 Hays et al. ..... 399/285
5,483,269 A * 1/1996 van Stiphout et al. ..... 347/55
5,508,727 A * 4/1996 Zur ..... 347/112
5,648,839 A * 7/1997 Koshino et al. ..... 399/271
5,767,885 A * 6/1998 Zur ..... 347/115
5,774,159 A * 6/1998 Larson ..... 347/151
5,777,576 A * 7/1998 Zur et al. ..... 347/120
5,851,717 A * 12/1998 Tsubuko et al. ..... 430/108.21
6,014,157 A 1/2000 Slot et al.

(Continued)

FOREIGN PATENT DOCUMENTS

JP 59-224369 A 12/1984

(Continued)

*Primary Examiner* — Charlie Peng
*Assistant Examiner* — Peter Radkowski
(74) *Attorney, Agent, or Firm* — Sughrue Mion, PLLC

(57) ABSTRACT

An image forming element includes an image drum including a plurality of ring electrodes and a slot. The plurality of ring electrodes are formed to be spaced apart from one another on a circumference of the image drum. The slot is formed in a longitudinal direction on the image drum. A connecting member includes a plurality of connecting electrodes and is disposed inside the image drum so that an end of the connecting member is received in the slot. The connecting electrodes are electrically connected with the ring electrodes one to one on the same line.

32 Claims, 16 Drawing Sheets

U.S. PATENT DOCUMENTS

| | | | | |
|---|---|---|---|---|
| 6,040,847 | A * | 3/2000 | van Eekhout et al. | 347/151 |
| 6,045,679 | A * | 4/2000 | Slot et al. | 205/127 |
| 6,154,238 | A * | 11/2000 | Cook et al. | 347/55 |
| 6,198,900 | B1 * | 3/2001 | Wakahara | 399/313 |
| 6,281,506 | B1 * | 8/2001 | Fujita et al. | 250/370.09 |
| 6,296,347 | B1 * | 10/2001 | Shibata | 347/55 |
| 6,409,314 | B1 * | 6/2002 | Kitaoka et al. | 347/55 |
| 6,795,101 | B2 * | 9/2004 | Van Der Meer et al. | 347/142 |
| 6,817,701 | B2 * | 11/2004 | Kitazawa et al. | 347/55 |
| 7,008,740 | B2 * | 3/2006 | Fukuda | 430/125.32 |
| 7,266,333 | B2 * | 9/2007 | Hara | 399/302 |
| 2002/0158956 | A1 * | 10/2002 | Van Der Meer et al. | 347/141 |
| 2003/0058319 | A1 * | 3/2003 | Kitazawa et al. | 347/103 |
| 2004/0009343 | A1 * | 1/2004 | Igarashi et al. | 428/327 |
| 2004/0030439 | A1 * | 2/2004 | Vaidyanathan et al. | 700/122 |
| 2006/0285873 | A1 * | 12/2006 | Saeki | 399/101 |
| 2008/0131175 | A1 * | 6/2008 | Shin et al. | 399/313 |

FOREIGN PATENT DOCUMENTS

| | | | |
|---|---|---|---|
| JP | 62-292450 | A | 12/1987 |
| JP | 04-366873 | A | 12/1992 |
| JP | 07-219390 | A | 8/1995 |
| JP | 10-301402 | A | 11/1998 |

* cited by examiner

IMAGE FORMING ELEMENT AND MANUFACTURING METHOD THEREOF

CROSS-REFERENCE TO RELATED APPLICATIONS

This application claims priority from Korean Patent Application No. 10-2006-0120510, filed on Dec. 1, 2006, in the Korean Intellectual Property Office, the disclosure of which is incorporated herein by reference in its entirety.

BACKGROUND OF THE INVENTION

1. Field of the Invention

Methods and apparatuses consistent with the present invention relate to an image forming element for selectively adsorbing a toner for image formation. More particularly, the present invention relates to an image forming element and a manufacturing method thereof.

2. Description of the Related Art

FIG. 1 is a side view illustrating a structure of an image forming apparatus using a related art ring conductor, FIG. 2 is a schematic perspective view illustrating a related art image forming element, and FIG. 3 is an enlarged cross-sectional view illustrating a portion of the circumferential wall of the image forming element of FIG. 2. The image forming element shown in FIGS. 2 and 3 is disclosed in U.S. Pat. No. 6,014,157, which is incorporated herein by reference in its entirety.

Referring to FIGS. 1 through 3, the related art image forming apparatus includes a toner supply unit 40, an image forming element 10 to which a toner 1 is adsorbed from the toner supply unit 40 by an electrostatic force, a magnetic cutter 50 separating a part of the toner 1 adsorbed to the image forming element 10, and a toner return unit 60 that returns the toner 1 separated by the magnetic cutter 50 to the toner supply unit 40.

The toner supply unit 40 supplies the toner 1 from a toner storage unit 41 by using a toner supply roller 42. The image forming element 10 includes an image drum 12 and a plurality of ring electrodes 14 disposed on the image drum 12. Also, a control unit 16 is installed inside of the image drum 12 to individually apply a voltage to each of the ring electrodes 14. The magnetic cutter 50, which is able to separate the toner 1 adsorbed to the image forming element 10, is provided outside of the image drum 12.

In this structure, a part of the toner 1 transferred to the image forming element 10 from the toner supply unit 40 can be separated from the image forming element 10 through the magnetic cutter 50. The toner 1 remaining on the image forming element 10 can finally be transferred to a printing paper through an image transfer unit 70, and the printing paper is heated, thereby fixing the toner 1 to the printing paper.

However, the related art image forming apparatus has problems in that it is difficult and expensive to manufacture or repair the image forming element 10. Particularly, although the ring electrodes 14 of the image forming element 10 may be designed variously depending on required resolution, it is required that grooves having a width of approximately 20 μm should be formed uniformly at constant intervals of 42.3 μm on the image drum 12 to form the ring electrodes having a resolution of 600 dpi (dots per inch). Also, to electrically connect each of the ring electrodes 14 with the control unit 16, holes connected with each other should be formed inside and outside of the image drum 12 and should be filled with conductive materials, thereby complicating related manufacturing process steps. This increases the number of the manufacturing process steps, which are expensive and time consuming. As a result, printers made using the related art image forming apparatus have a high cost making popular acceptance for such printers difficult to achieve.

Furthermore, the related art image forming apparatus has problems in that it is difficult to manufacture the control unit 16 at a small size and thus the size of the image forming element 10 increases. Namely, the size of the control unit 16 increases as the control unit 16 should be provided with a certain packaging area in which a plurality of control chips are packaged to control the voltage applied to each of the ring electrodes. This reduces space utility inside the image drum 12 and increases the size of the image drum 12.

Accordingly, an image forming element and a manufacturing method thereof, in which a structure and manufacturing process steps can be simplified and a small size can be obtained is needed.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

An aspect of the present invention provides an image forming element and a manufacturing method thereof, in which a structure and manufacturing process steps are simplified to reduce manufacturing costs.

An aspect of the present invention also provides an image forming element and a manufacturing method thereof, in which a plurality of ring electrodes are electrically connected with a device for independently controlling each of the ring electrodes, through a connecting member formed of fine pitches.

An aspect of the present invention also provides an image forming element and a manufacturing method thereof, in which an electrical connection structure of a plurality of ring electrodes is simplified.

An aspect of the present invention also provides an image forming element and a manufacturing method thereof, in which the image forming element is manufactured rapidly and easily, and is advantageous for mass production.

An aspect of the present invention also provides an image forming element and a manufacturing method thereof, which can improve space utility and obtain a small size.

In one aspect, the present invention relates to an image forming element including an image drum provided with a plurality of ring electrodes and a slot. The plurality of ring electrodes are spaced apart from one another on the circumference of the image drum. The slot is formed in a longitudinal direction on the image drum. A connecting member includes a plurality of connecting electrodes and is arranged inside the image drum so that an end of the connecting member is received in the slot. The connecting electrodes are electrically connected with the ring electrodes one to one on the same line.

An image forming element in accordance with an exemplary embodiment may be applied to an image forming apparatus that includes a toner supply unit, a magnetic cutter, and a toner return unit. In one exemplary embodiment, the image forming element may be applied to an image forming apparatus excluding any one of the toner supply unit, the magnetic cutter, and the toner return unit or additionally including any other units.

The connecting member serves to electrically connect a separate control unit with each of the ring electrodes. In one exemplary embodiment, the connecting member may be provided with a control device in a single body to provide a circuit for controlling each of the ring electrodes individually.

The connecting member may be formed of an ordinary insulating material, and may include a thin insulating sheet to be received in the slot. Each of the connecting electrodes may be received in the insulating sheet. In one exemplary embodiment, at least one of each connecting electrode may be exposed to the outside of the insulating sheet.

The respective connecting electrodes of the connecting member may be formed in the form of fine patterns so that they are spaced apart from one another at fine intervals. As an example, the respective connecting electrodes may be spaced apart from one another at a period (P) of about 2 μm to about 85 μm to have a fine pitch.

Furthermore, the connecting member may be formed of a flexible material. As an example, an ordinary flexible printed circuit board (FPCB) may be used as the connecting member. The connecting member may be arranged inside the image drum in a substantially straight line. Alternatively, the connecting member may be arranged in a winding state. Otherwise, the connecting member may be arranged in a predetermined folding or bending state. In one exemplary embodiment, the connecting member may be formed of a rigid material that can form the connecting electrodes of fine patterns.

Furthermore, a clamp member may be provided between the connecting member and the slot. The connecting member can be fixably received in the slot through the clamp member. In one exemplary embodiment, instead of a separate clamp member, the connecting member may be directly affixed into the slot.

The connecting member may include a control device for electrical control of each of the ring electrodes. The connecting member serves to connect each of the ring electrodes with the inside of the image drum and at the same time is provided with the control device in a single body to control each of the ring electrodes. Alternatively, a separate rigid circuit board may electrically connected with the connecting member, and a control device for electrical control of each of the ring electrodes may be provided at any one of the connecting member and the rigid circuit board.

A support member may be provided inside the image drum, and the connecting member and/or the rigid circuit board may be maintained and supported inside the image drum through the support member.

The image forming element may include a single connecting member. In one exemplary embodiment, the image forming element may include a plurality of connecting members. When the image forming element includes a plurality of connecting members, one end of each connecting member is received in the slot in a state that one end of each connecting member is in surface contact with another end of each connecting member. In one exemplary embodiment, a plurality of slots may be formed to correspond to the respective connecting members so that each of the connecting members may be received independently in each of the slots.

In another aspect, the present invention relates to a method of manufacturing an image forming element, such as those described above. The method includes providing an image drum and a connecting member. The image drum includes a slot formed in a longitudinal direction, and the connecting member includes a plurality of connecting electrodes spaced apart from one another on the same plane and electrically insulated from one another. The connecting member is arranged inside the image drum so that one end of the connecting member is received in the slot and each connecting electrode is externally exposed from the image drum. A plurality of ring electrodes is formed on the circumference of the image drum to correspond to the respective connecting electrodes one to one and electrically connect with the connecting electrodes.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which.

DETAILED DESCRIPTION OF EXEMPLARY EMBODIMENTS OF THE INVENTION

Figure 1:
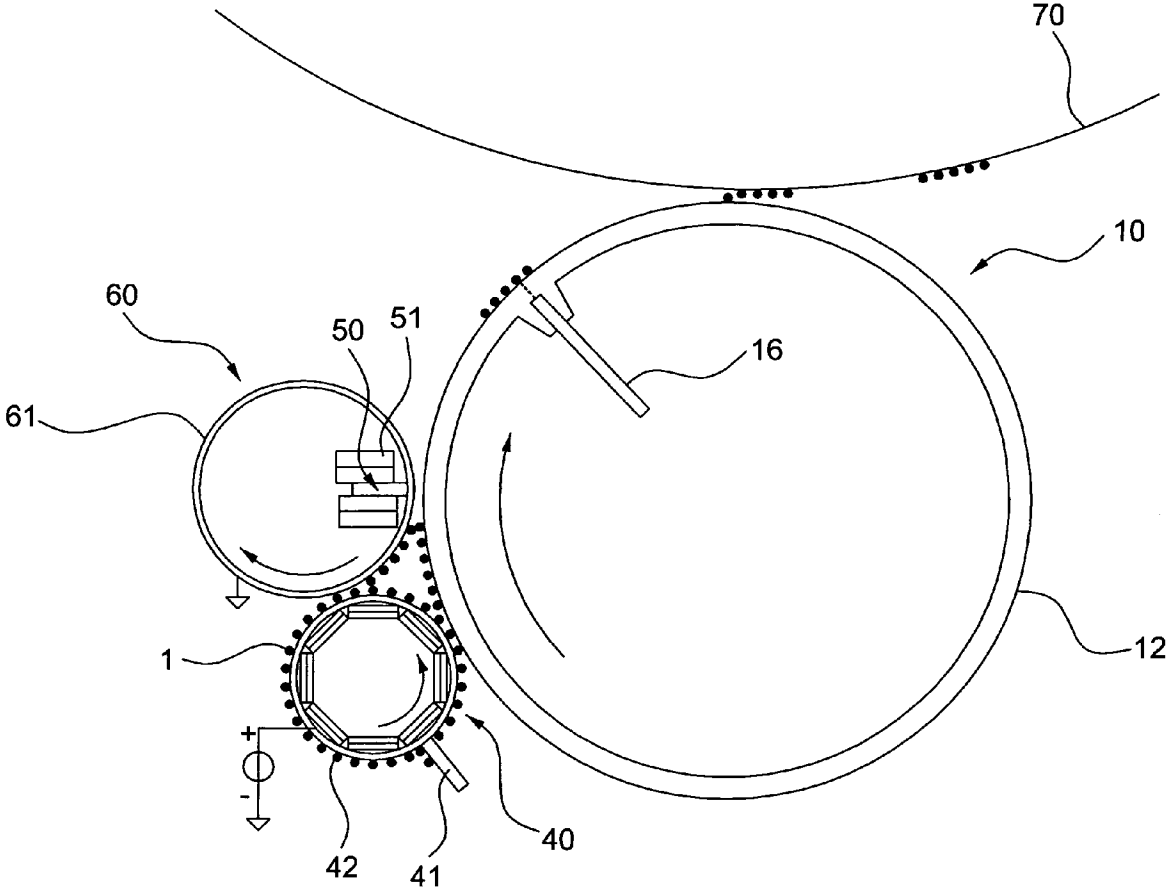
FIG. 1 (RELATED ART)
FIG. 1 is a side view illustrating a structure of a related art image forming apparatus.
Figure 2:
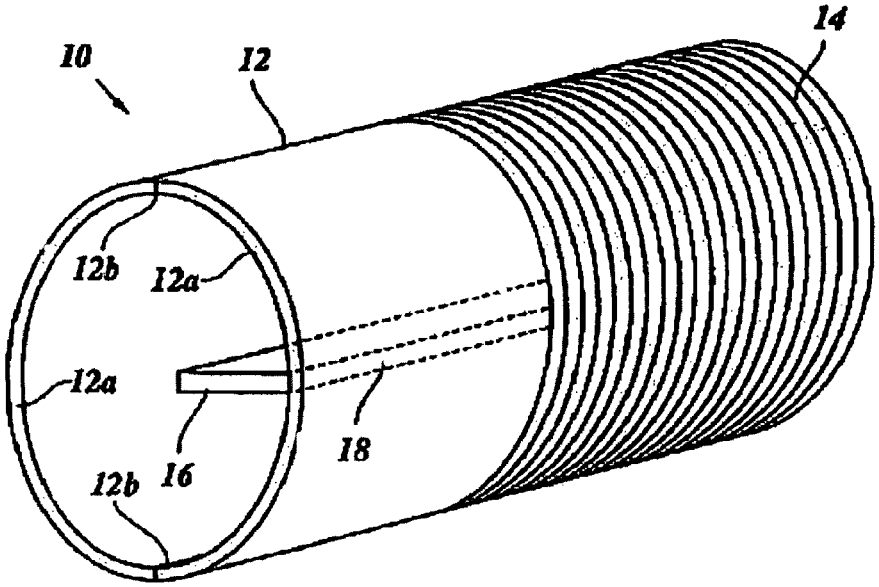
FIG. 2 (RELATED ART)
FIG. 2 is a schematic perspective view illustrating a structure of a related art image forming element.
Figure 3:
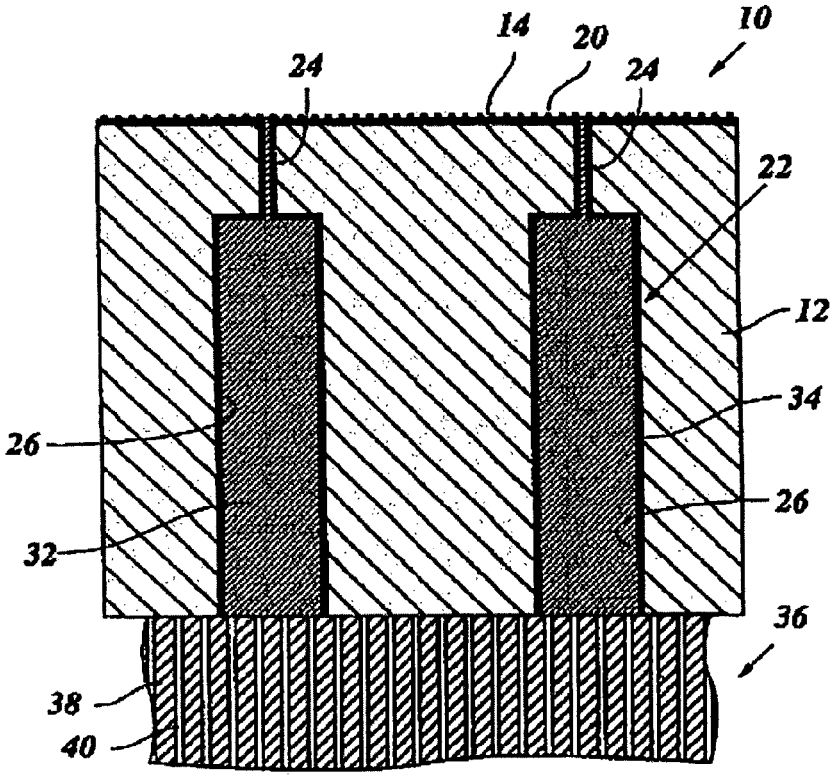
FIG. 3 (RELATED ART)
FIG. 3 is an enlarged cross-sectional view illustrating a portion of the circumferential wall of the image forming element of FIG. 2.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

Figure 4:
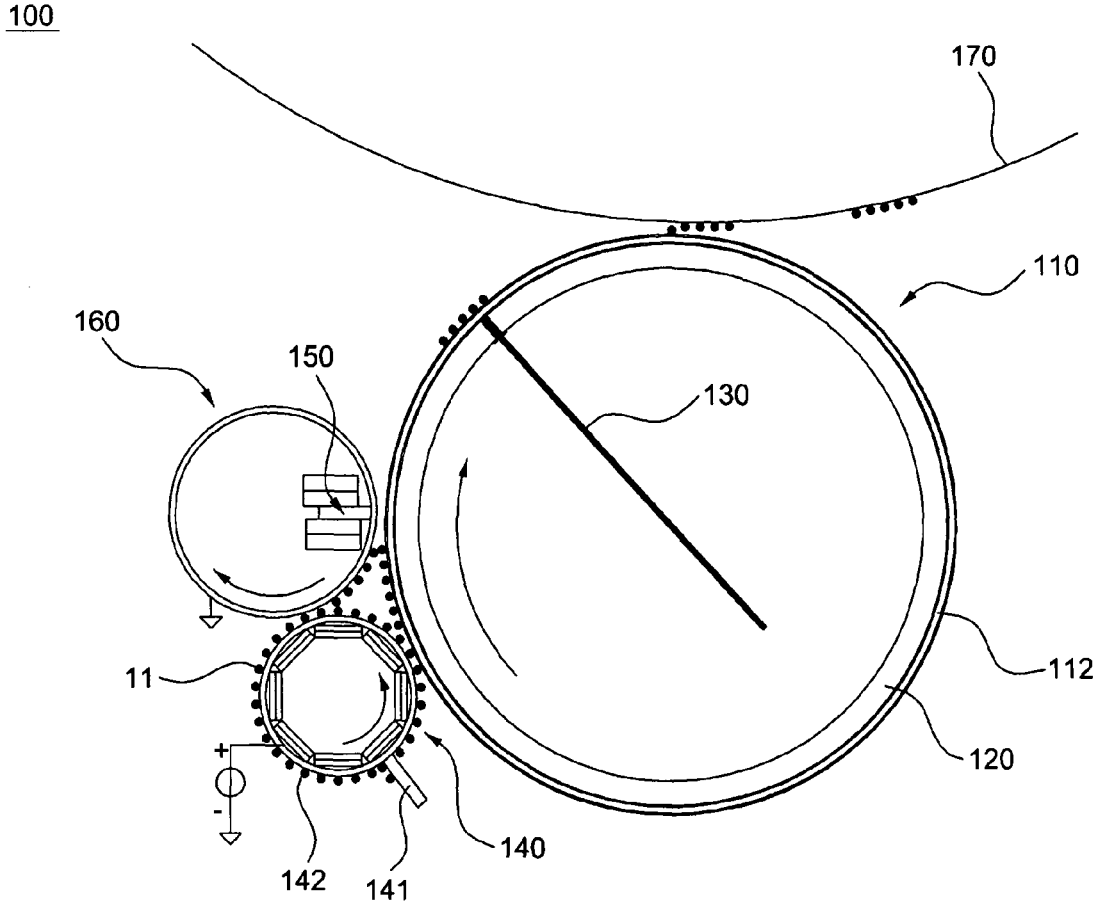
FIG. 4 is a side view illustrating a structure of an image forming apparatus to which an image forming element according to a first exemplary embodiment of the present invention is applied.
Figure 5:
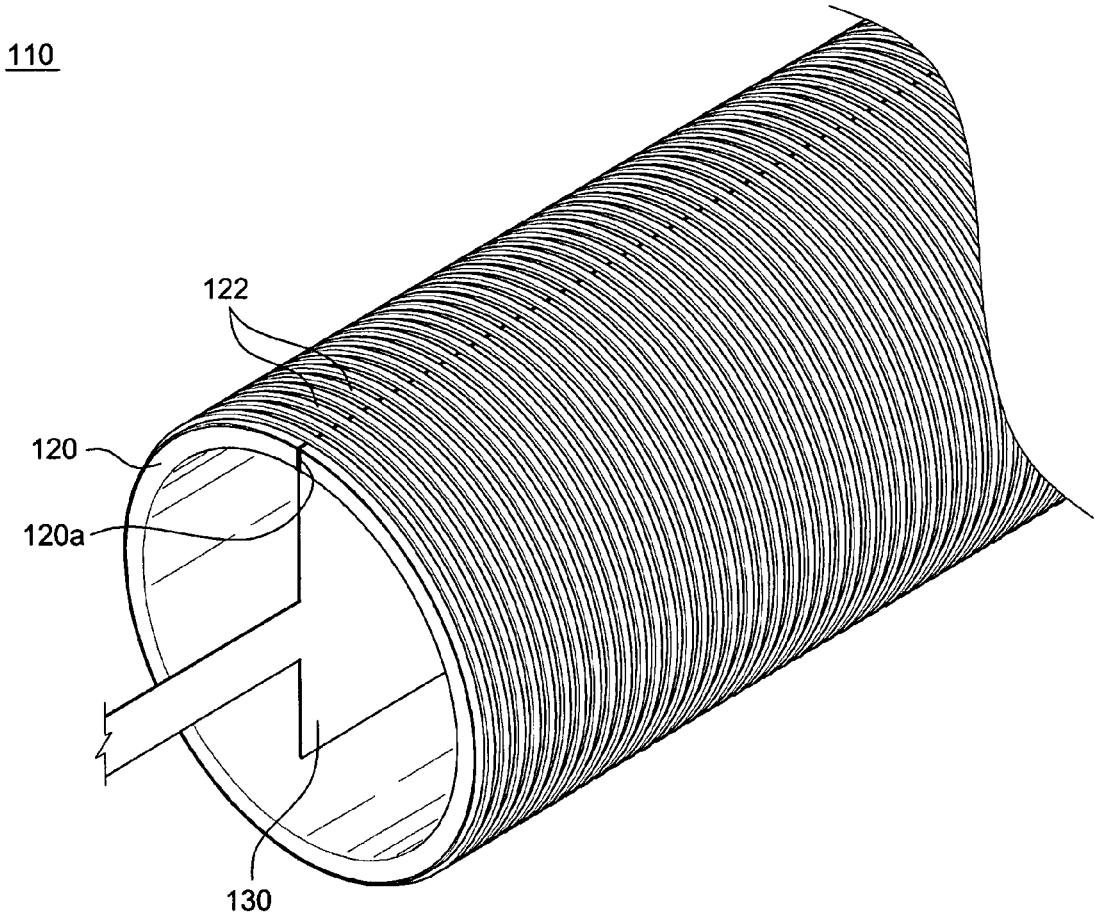
FIG. 5 is a perspective view illustrating a structure of an image forming element of the image forming apparatus according to the first exemplary embodiment of the present invention.
Figure 6:
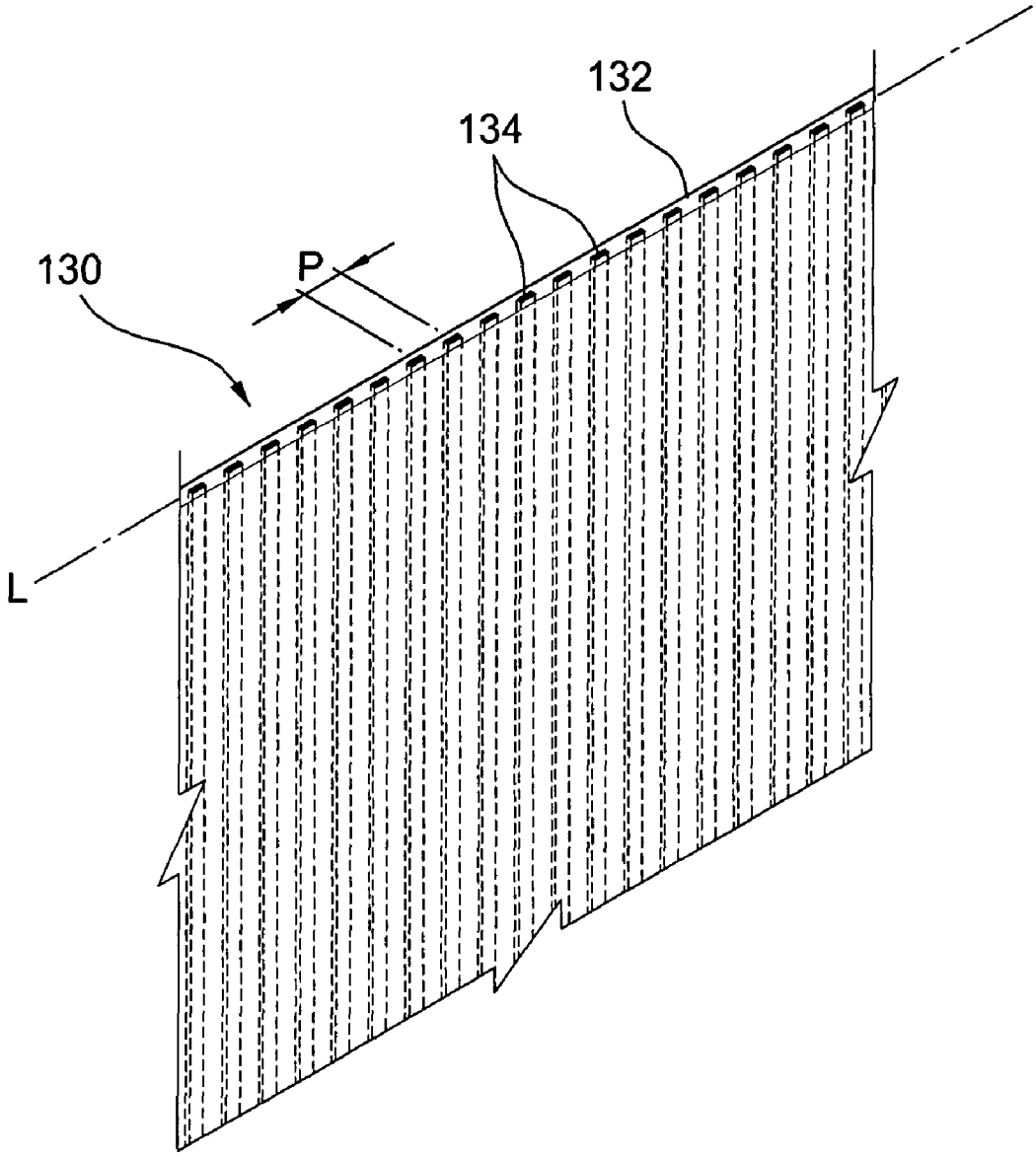
FIG. 6 is a perspective view illustrating a structure of a connecting member of the image forming element according to the first exemplary embodiment of the present invention.
Figure 7:
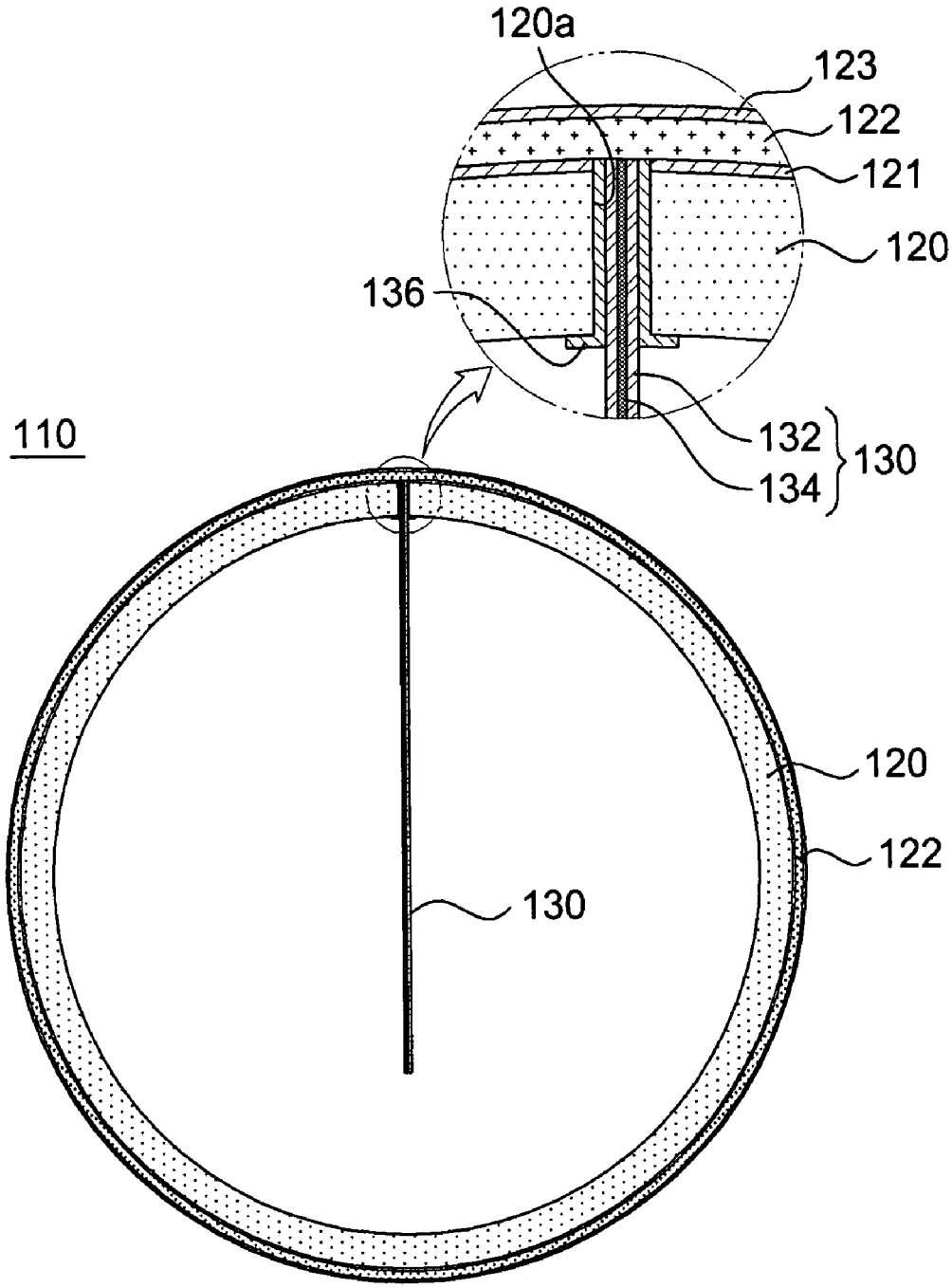
FIGS. 7 and 8 are a cross-sectional view and a longitudinal sectional view illustrating a structure of the image forming element according to the first exemplary embodiment of the present invention.
Figure 8:
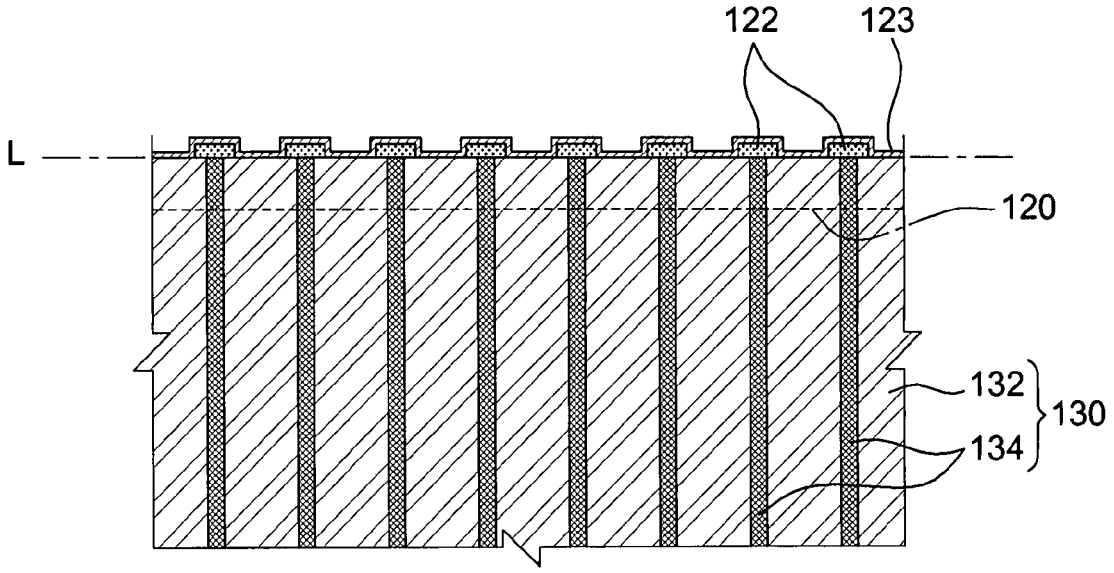

In FIG. 4, an image forming element 110 according to a first exemplary embodiment is shown. The image forming element 110 includes an image drum 120 and a connecting member 130. Hereinafter, an example of the image forming element 110 applied to an image forming apparatus 100 will be described, wherein the image forming apparatus 100 includes a toner supply unit 140, a magnetic cutter 150, and a toner return unit 160. In one exemplary embodiment, the image forming element may be applied to an image forming apparatus excluding any one of the toner supply unit, the magnetic cutter, and the toner return unit or additionally including any other units.

The toner supply unit 140 supplies a toner 11 from a toner storage unit 141 by using a toner supply roller 142. The toner 11 can be adsorbed to the image forming element 110 from the toner supply unit 140 by an electrostatic force. A part of the toner 11 transferred from the toner supply unit 140 to the image forming element 110 can be separated from the image forming element 110 by the magnetic cutter 150. The toner 11 remaining on the image forming element 110 can finally be transferred to a printing paper by an image transfer unit 170. Then, the printing paper is heated, thereby fixing the toner 11 to the printing paper. The toner separated by the magnetic cutter 150 can be returned to the toner supply unit 140 by the toner return unit 160.

Turning to FIGS. 5 to 8, the image forming element 110 according to the first exemplary embodiment of the present invention is shown. The image forming element 110 includes an image drum 120 and a connecting member 130. The image drum 120 includes a plurality of ring electrodes 122 and a slot 120*a*. The ring electrodes 122 are formed to be spaced apart from one another on a circumference of the image drum 120, and the slot 120*a* is formed in a longitudinal direction. The connecting member 130 is provided with a plurality of connecting electrodes 134 electrically connected with the ring electrodes 122 one to one on the same line, such that the connecting parts of the connecting electrodes 134 and the ring electrodes 122 may be arranged on one single line L. The connecting member 130 is arranged inside the image drum 120 so that an end of the connecting member 130 is received in the slot 120*a*.

The image drum 120 has a hollow cylindrical shape and may be formed of an ordinary metal material, such as aluminum. The image drum 120 is rotatably installed and arranged near the toner supply unit 140. The slot 120*a* having a predetermined width is formed at one side of a main wall of the image drum 120 to pass in a longitudinal direction, and the plurality of ring electrodes 122 are formed on the circumference of the image drum 120 in parallel so that they are spaced apart from one another at regular intervals in a longitudinal direction of the image drum 120. The ring electrodes 122 are electrically insulated from one another. Here, an insulating layer 121 may be formed on the circumference of the image drum 120. The ring electrodes 122 are spaced apart from one another on the circumference of the insulating layer 121. In this case, the ring electrodes 122 are spaced apart from one another at fine intervals to develop an image in a high resolution.

In the first exemplary embodiment of the present invention, the image drum 120 is formed of a conductive material, and the insulating layer 121 is separately formed on the circumference of the image drum 120. However, in another exemplary embodiment, the image drum 120 may be used as an insulator without formation of the insulating layer 121.

The connecting member 130 is formed of an ordinary insulating material, and may include a thin insulating sheet 132 to be received in the slot 120*a*. As an example, the insulating sheet 132 may be formed of an ordinary polymer such as polyimide having excellent electrical insulating property. Also, the connecting electrodes 134 are formed on one surface of the insulating sheet 132 and each of the connecting electrodes 134 is spaced apart from one another so that the connecting electrodes 134 are disposed coplanar and parallel to each other. The insulating sheet 132 may include a plurality of insulating sheet layers overlapped with one another, and each connecting electrode may be arranged between the respective insulating sheet layers. Namely, after being formed on any one of the insulating sheet layers, each connecting electrode may be covered by another insulating sheet layer. In the first exemplary embodiment of the present invention, each connecting electrode 134 is interposed between the respective insulating sheet layers constituting the insulating sheet 132 and is received in the insulating sheet. However, in another exemplary embodiment, each connecting electrode 134 may be formed in such a manner that at least one side may be externally exposed from a side of the insulating sheet 132.

The connecting member 130 may be formed of a flexible material. The respective connecting electrodes 134 may be formed in the form of fine patterns so that they are spaced apart from one another at fine intervals. As an example, the respective connecting electrodes 134 may be spaced apart from one another at a period (P) of about 2 μm to about 85 μm. In one exemplary embodiment, when the respective connecting electrodes 134 are spaced apart from one another at a period of 42.3 μm, the respective ring electrodes 122 electrically connected with the respective connecting electrodes 134 one to one are also spaced apart from one another at a period of 42.3 μm.

An ordinary flexible printed circuit board (FPCB) may be used as the aforementioned connecting member 130. In one exemplary embodiment, the connecting member may be formed of a rigid material that can form the connecting electrodes of fine patterns.

Furthermore, the connecting member 130 may be arranged inside the image drum 120 in a substantially straight line. Alternatively, the connecting member 130 may be arranged in a winding state. Also, the connecting member 130 may be arranged in a predetermined folding or bending state.

A clamp member 136 may be provided between the connecting member 130 and the slot 120*a*. The connecting member 130 can be fixably received in the slot 120*a* through the clamp member 136. The clamp member 136 may be formed of an ordinary adhesive. In one exemplary embodiment, instead of a separate clamp member 136, the connecting member may directly be fixed into the slot 120*a*. Also, an insulating film 123 of an ordinary dielectric material may be formed on the circumference of each of the ring electrodes 122 electrically connected to the connecting electrodes 134 one to one.

Figure 9:
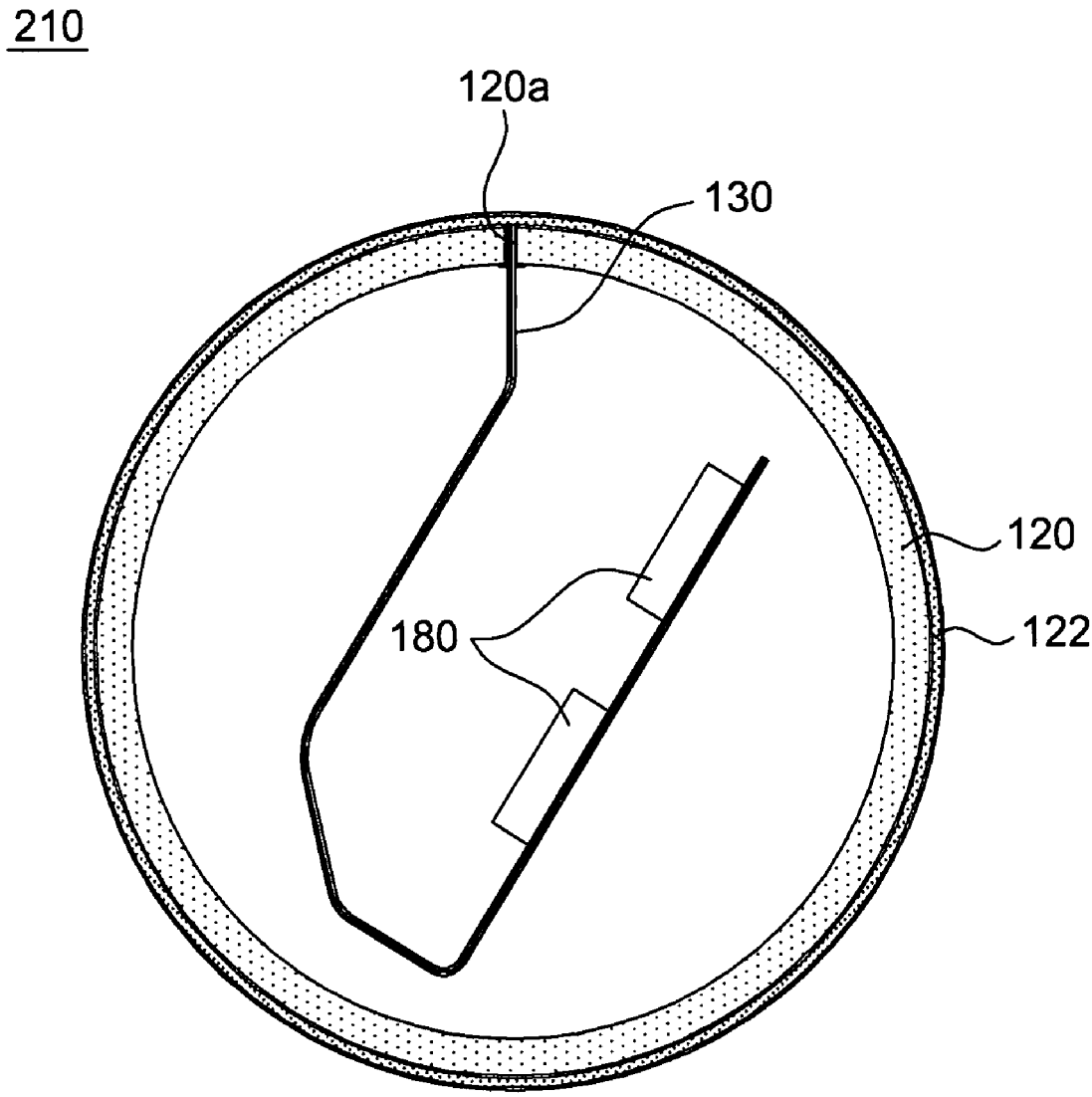
FIG. 9 is a cross-sectional view illustrating a structure of an image forming element according to a second exemplary embodiment of the present invention.

In FIG. 9, an image forming element 210 according to a second exemplary embodiment of the present invention is shown. The image forming element 210 includes an image drum 120 and a connecting member 130. The image drum 120 includes a plurality of ring electrodes 122 and a slot 120*a*. The ring electrodes 122 are formed to be spaced apart from one another on the circumference of the image drum 120. The slot 120*a* is formed in a longitudinal direction. The connecting member 130 includes a plurality of connecting electrodes 134 electrically connected with the ring electrodes 122 one to one on the same line, and is arranged inside the image drum 120 so that an end of the connecting member 130 is received in the slot 120*a*. The connecting member 130 includes a control device 180 for electrically controlling each of the ring electrodes 122 individually.

In the aforementioned first exemplary embodiment of the present invention, the connecting member 130 serves to connect each of the ring electrodes 122 formed on the circumference of the image drum 120 with the inside of the image drum 120. According to the second exemplary embodiment of the present invention, the connecting member 130 serves to connect each of the ring electrodes 122 formed on the circumference of the image drum 120 with the inside of the image drum 120 and at the same time is provided with the control device 180 in a single body to control each of the ring electrodes 122 individually. The control device 180 may include a plurality of control chips to independently apply a voltage to each of the ring electrodes 122. The control chips may be, for example, an application-specific integrated circuit (ASIC).

Figure 10:
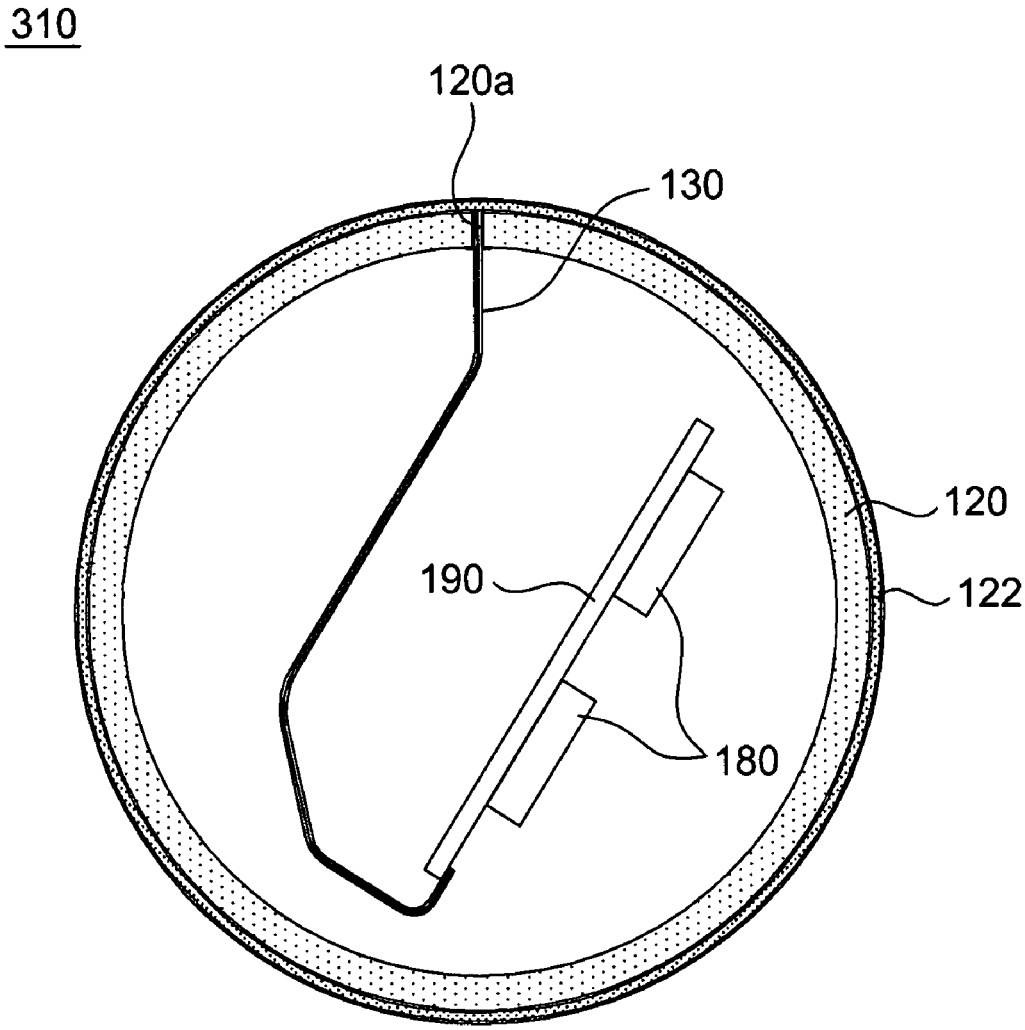
FIG. 10 is a cross-sectional view illustrating a structure of an image forming element according to a third exemplary embodiment of the present invention.

Turning to FIG. 10, an image forming element 310 according to a third exemplary embodiment of the present invention is shown. The image forming element 310 includes an image drum 120, a connecting member 130, and a rigid circuit board 190. The image drum 120 includes a plurality of ring electrodes 122 and a slot 120*a*. The ring electrodes 122 are formed to be spaced apart from one another on the circumference of the image drum 120. The slot 120*a* is formed in a longitudinal direction. The connecting member 130 includes a plurality of connecting electrodes 134 electrically connected with the ring electrodes 122 one to one on the same line, and is arranged inside the image drum 120 so that an end of the connecting member 130 is received in the slot 120*a*. The rigid circuit board 190 is electrically connected with the connecting member 130. A control device 180 for electrically controlling each of the ring electrodes 122 is provided at any one of the connecting member 130 and the rigid circuit board 190.

A printed circuit board (PCB) which is typically used to allow various devices to be packaged therein may be used as the rigid circuit board 190. The control device 180 may include a plurality of control chips for applying a voltage to each of the ring electrodes 122 independently.

Furthermore, the rigid circuit board 190 may be arranged inside the image drum 120 along with the connecting member 130. In one exemplary embodiment, the rigid circuit board 190 may be arranged outside the image drum 120 such that the rigid circuit board 190 is electrically connected with the image drum 120. Alternatively, another connecting member the same as or similar to the aforementioned connecting member may be connected instead of the flexible circuit board.

Figure 11:
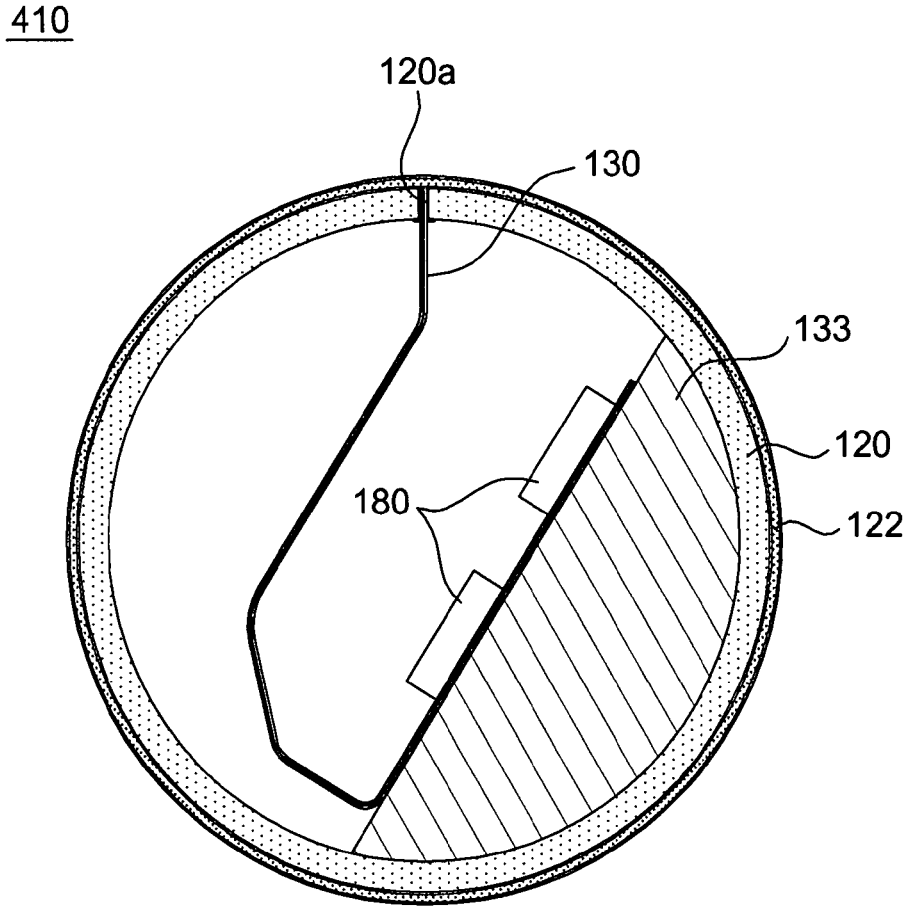
FIG. 11 is a cross-sectional view illustrating a structure of an image forming element according to a fourth exemplary embodiment of the present invention.

In FIG. 11, an image forming element 410 according to a fourth exemplary embodiment of the present invention is shown. The image forming element 410 includes an image drum 120, a connecting member 130, and a support member 133. The image drum 120 includes a plurality of ring electrodes 122 and a slot 120*a*. The ring electrodes 122 are formed to be spaced apart from one another on the circumference of the image drum 120. The slot 120*a* is formed in a longitudinal direction. The connecting member 130 includes a plurality of connecting electrodes 134 electrically connected with the ring electrodes 122 one to one on the same line, and is arranged inside the image drum 120 so that an end of the connecting member 130 is received in the slot 120*a*. The support member 133 is arranged inside the image drum 120 to support the connecting member 130.

In the aforementioned second and third exemplary embodiments of the present invention, one end of the connecting member 130 is connected with the ring electrodes 122 while the other end of the connecting member 130 is arranged inside the image drum 120 in a free end type. However, according to the fourth exemplary embodiment of the present invention, the support member 133 may separately be provided inside the image drum 120, and the other end of the connecting member 130 may be maintained and supported inside the image drum 120 through the support member 133. Also, the support member 133 may be fixed inside the image drum 120 through an ordinary fitting member or adhesive. Furthermore, the support member for maintaining and supporting the rigid circuit board 190 may be provided inside the image drum even in the case that the rigid circuit board 190 electrically connected with the connecting member 130 is arranged inside the image drum 120 in the same manner as the third embodiment.

Figure 12:
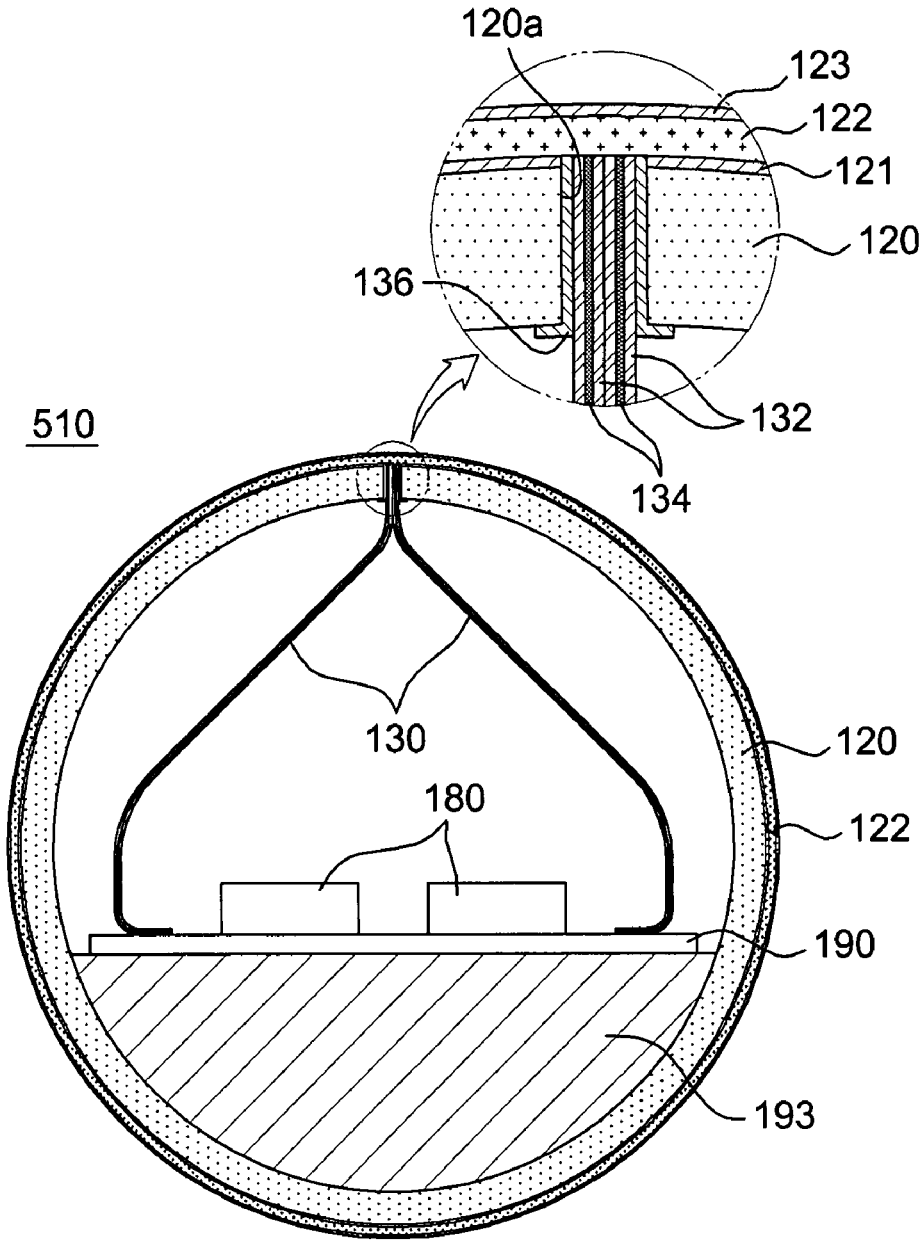
FIG. 12 is a cross-sectional view illustrating a structure of an image forming element according to a fifth exemplary embodiment of the present invention.

Turning to FIG. 12, an image forming element 510 according to a fifth exemplary embodiment of the present invention is shown. The image forming element 510 includes an image drum 120 and a plurality of connecting members 130. The image drum 120 includes a plurality of ring electrodes 122 and a slot 120*a*. The ring electrodes 122 are formed to be spaced apart from one another on the circumference of the image drum 120. The slot 120*a* is formed in a longitudinal direction. Each of the connecting members 130 includes a plurality of connecting electrodes 134 electrically connected with the ring electrodes 122 one to one on the same line, and is arranged inside the image drum 120 so that an end of the connecting members 130 is received in the slot 120*a*. One end of each of the connecting members 130 is received in the slot 120*a* in a state where each end of the connecting members 130 is in surface-contact with another end.

Namely, the plurality of connecting members 130 may be provided, and each connecting member 130 is received in the slot 120*a* in a state where each end of the connecting members 130 is in surface-contact with another end. Each of the connecting members 130 may electrically be connected with each of the ring electrodes 122. In this case, the connecting electrodes 134 formed in any one of the connecting members 130 alternating with other connecting electrodes 134 formed in another one of the connecting members 130 so as to correspond to the respective ring electrodes 122 of the image drum 120, wherein the connecting electrodes formed in any one of the connecting members 130 are in surface-contact with other connecting electrodes formed in another one of the connecting members 130.

The rigid circuit board 190 may be connected to the other end of each connecting member 130 so that the rigid circuit board 190 may electrically be connected with each connecting member 130. The rigid circuit board 190 may be maintained and supported through a support member 193 provided in the image drum 120. Also, a control device 180 may be provided on each connecting member 130 to electrically control each of the ring electrodes 122 individually. In one exemplary embodiment, the control device 180 may be provided without the rigid circuit board 190 and the support member 193.

Image forming elements in accordance with exemplary embodiments of the present invention may be manufactured using the following method. In the method, an image drum 120 and a connecting member 130 are provided. The image drum 120 includes a slot 120*a* formed in a longitudinal direction, and the connecting member 130 includes a plurality of connecting electrodes 134 spaced apart from one another on the same plane and electrically insulated from one another. The connecting member 130 is arranged inside the image drum so that one end of the connecting member 130 is received in the slot 120*a* and each connecting electrode 134 is exposed to the outside of the image drum. A plurality of ring electrodes 122 are formed on the circumference of the image drum 120 to correspond to the respective connecting electrodes 134 one to one and electrically connect with the connecting electrodes 134.

First, the image drum 120 and the connecting member 130 are separately prepared to manufacture the image forming element.

Figure 13:
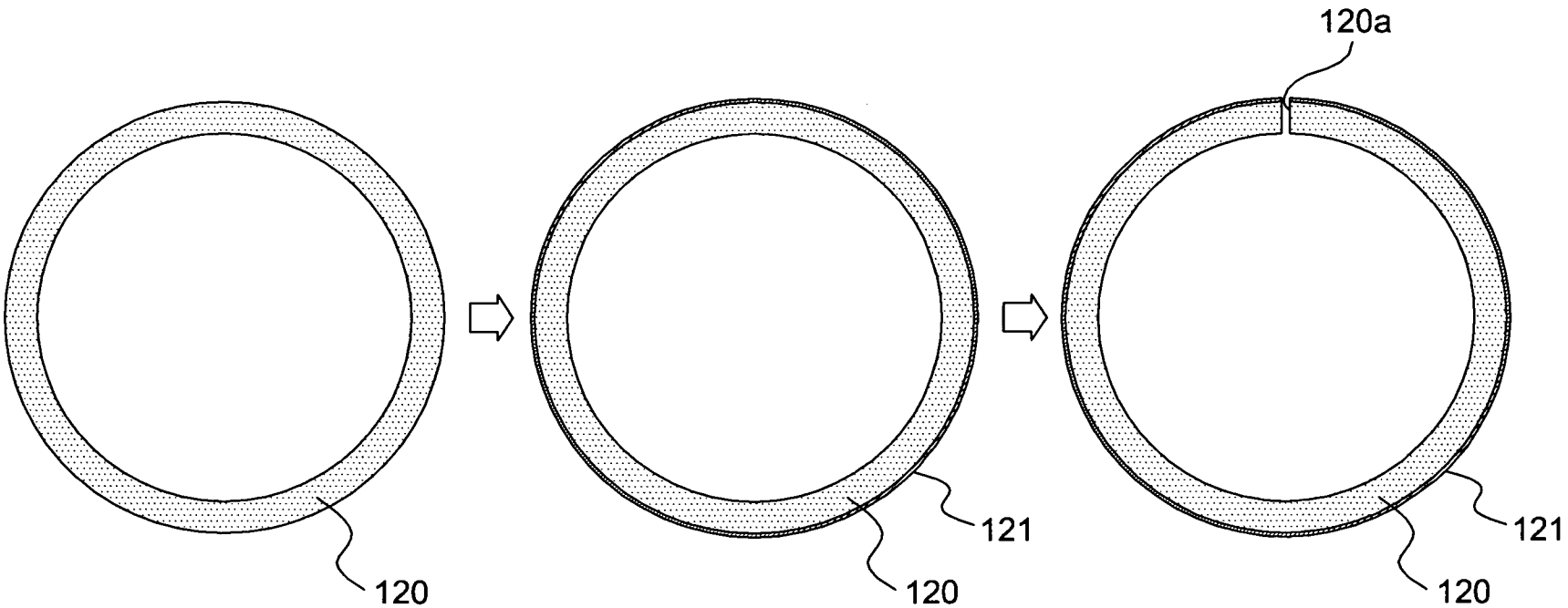
FIGS. 13 to 17 illustrate a manufacturing method of an image forming element according to another exemplary embodiment of the present invention.

As shown in FIG. 13, the image drum 120 has a hollow cylindrical shape, which may be formed of aluminum. An insulating layer 121 is formed on the circumference of the image drum 120. Afterwards, the slot 120*a* is formed on the main wall of the image drum 120 in a longitudinal direction by an ordinary mechanical process or an etching process. Examples of the insulating layer 121 include an oxide membrane layer formed by anodizing and a polymer based insulating coating layer. In one exemplary embodiment, the image drum may be formed of an insulating material, wherein the insulating layer may be excluded.

Figure 14:
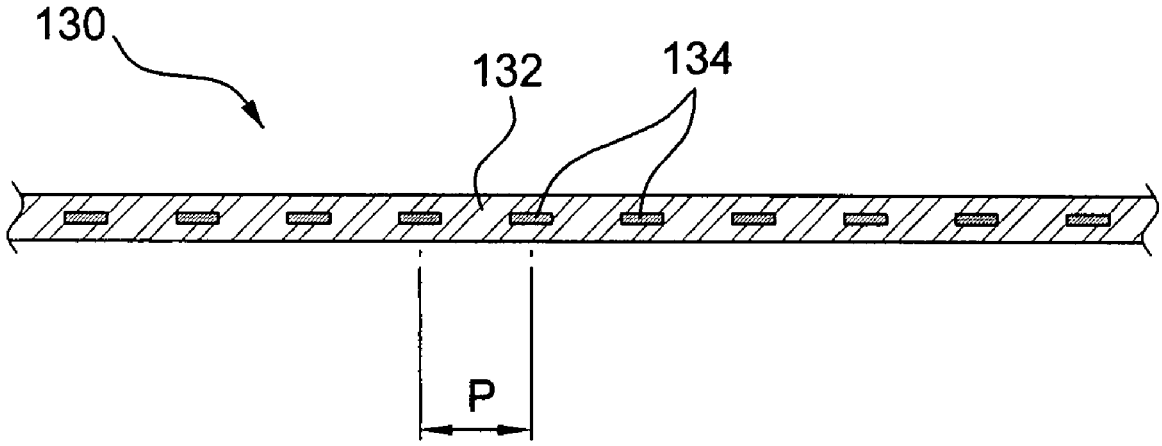

As shown in FIG. 14, the connecting member 130 includes the plurality of connecting electrodes 134 spaced apart from one another at fine intervals on an insulating sheet 132, which may be formed of an ordinary insulating material by an etching process or a printing process. The insulating sheet 132 may be formed of polyimide having excellent electrical insulating property, and each connecting electrode 134 may be formed of an ordinary conductive material. Also, the respective connecting electrodes 134 are disposed coplanar in a straight line and are spaced apart from one another. As an example, the respective connecting electrodes 134 may be formed at a period (P) of about 2 μm to about 85 μm.

The connecting member may be formed of a flexible material such as a flexible printed circuit board (FPCB). In one exemplary embodiment, the connecting member may be formed of a rigid material that can form connecting electrodes of fine patterns. Also, a single connecting member or a plurality of connecting members may be provided.

Figure 15:
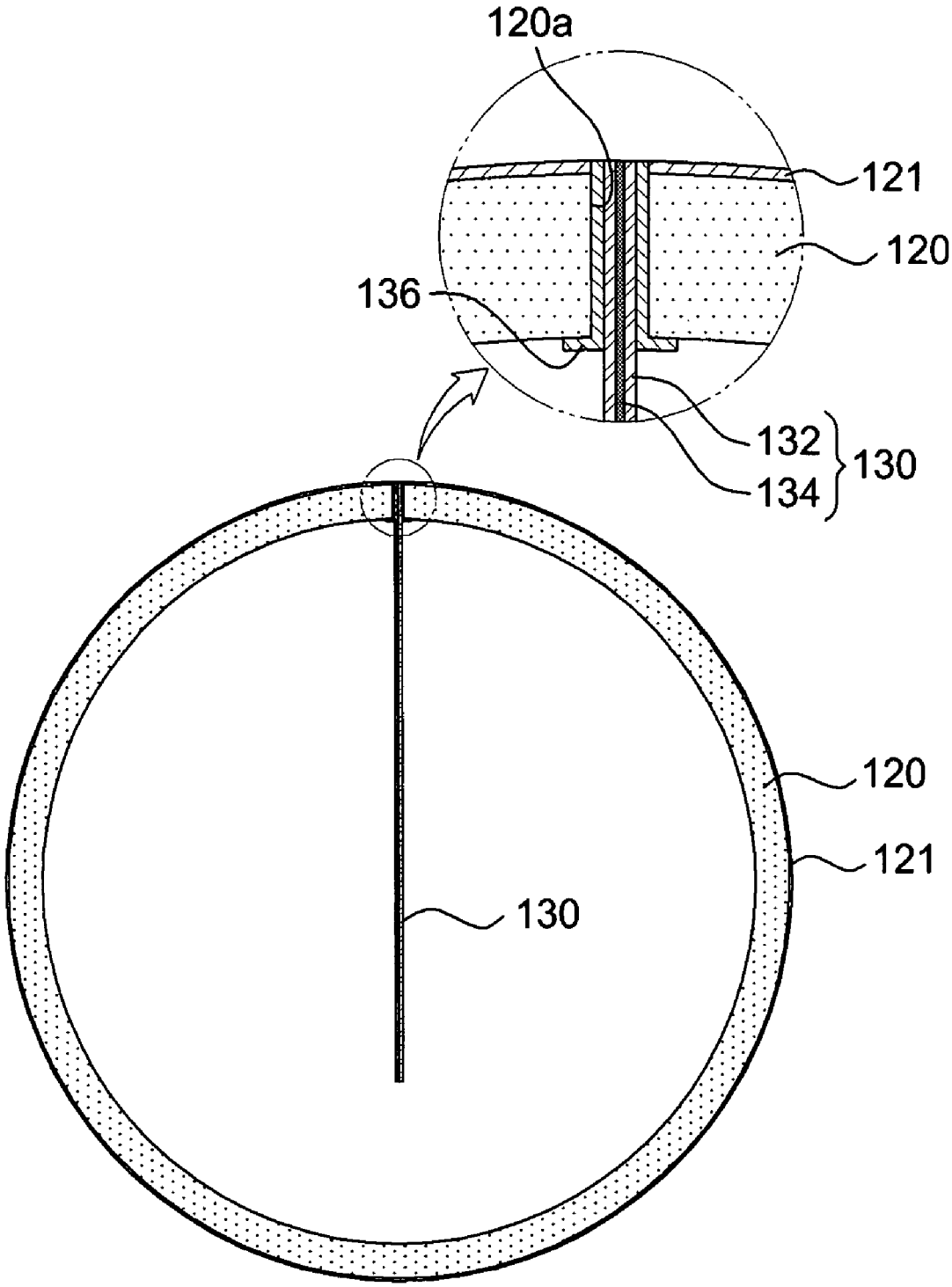

Next, as shown in FIG. 15, one end of the connecting member 130 is received in the slot 120*a*. The connecting member 130 is arranged inside the image drum 120 so that each connecting electrode is exposed to the outside of the image drum 120.

At this time, the connecting member 130 is received in the slot 120*a* so that one end of each connecting electrode 134 is arranged on the same circumference as that of the image drum 120. Alternatively, after a part of the connecting member 130 is arranged to be extended to the outside of the image drum 120, the extended portion may be removed.

The connecting member 130 received in the slot 120*a* may be fixed by a clamp member 136 interposed between the connecting member 130 and the slot 120*a*, wherein the clamp member 136 may be formed of an ordinary adhesive. In one exemplary embodiment, the connecting member 130 may directly be fixed into the slot 120*a*.

Furthermore, as described above, the connecting member 130, which is arranged inside the image drum 120 so that an end of the connecting member 130 is received in the slot 120*a*, may be provided inside the image drum 120 in a substantially straight line state, a winding state, or a predetermined folded or bent state.

In the embodiments as aforementioned and shown, it has been described that, after the insulating layer 121 is formed on the circumference of the image drum 120, the connecting member 130 is arranged on the image drum 120. However, in another exemplary embodiment, before the insulating layer is formed, a part of the connecting member may be arranged to be extended to the outside of the image drum, so that the insulating layer may be formed to surround the connecting member. Then, the extended portion extended to the outside of the insulating layer may be removed.

Also, the connecting member 130 may include a control device 180, as described with reference to FIG. 9, for electrically controlling each of the ring electrodes 122. The control device may include a plurality of control chips, such as an ASIC, for independently applying a voltage to each of the ring electrodes 122. The control device may be provided on the connecting member 130 by an ordinary soldering or die bonding. In one exemplary embodiment, a rigid circuit board 190, as described with reference to FIG. 10, packaged with the control device for electrical control of each of the ring electrodes 122 may electrically be connected with the connecting member 130. Also, a support member 133, as described with reference to FIG. 11, may be provided inside the image drum, and the connecting member 130 and/or the rigid circuit board may be maintained and supported through the support member.

Figure 16:
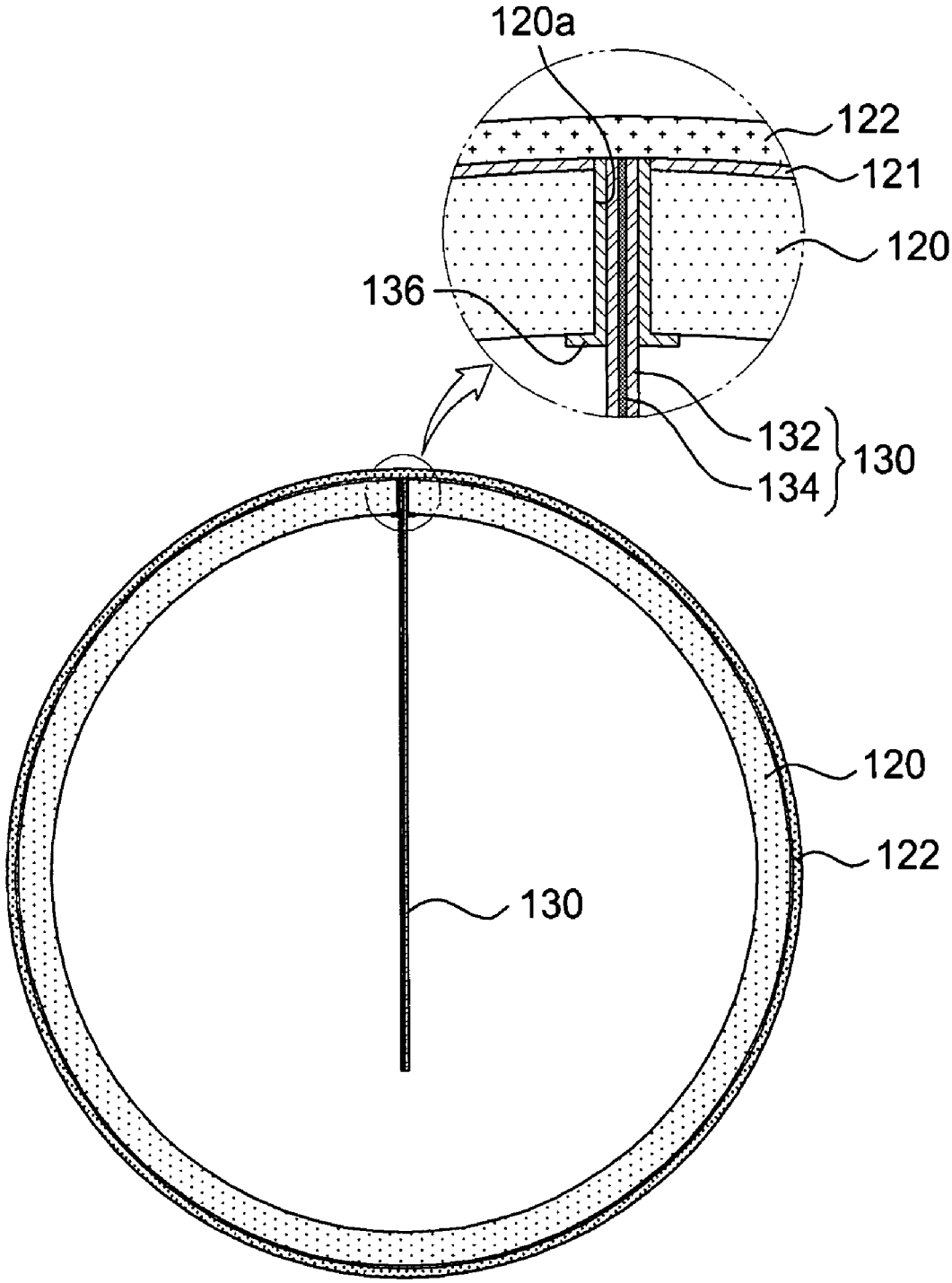

Next, as shown in FIG. 16, the plurality of ring electrodes 122 are formed on the circumference of the image drum 120 so that they are electrically connected with the respective connecting electrodes 134 one to one.

Each of the ring electrodes 122 has about the same width as that of each connecting electrode 134 so that the ring electrodes 122 are electrically connected with the connecting electrodes 134 one to one. The ring electrodes 122 are spaced apart from one another on the circumference of the image drum 120 at the same interval. Various methods may be used to form the ring electrodes 122, wherein examples of the methods include patterning, conductive pattern printing, electro or electroless plating, and sputtering.

Figure 17:
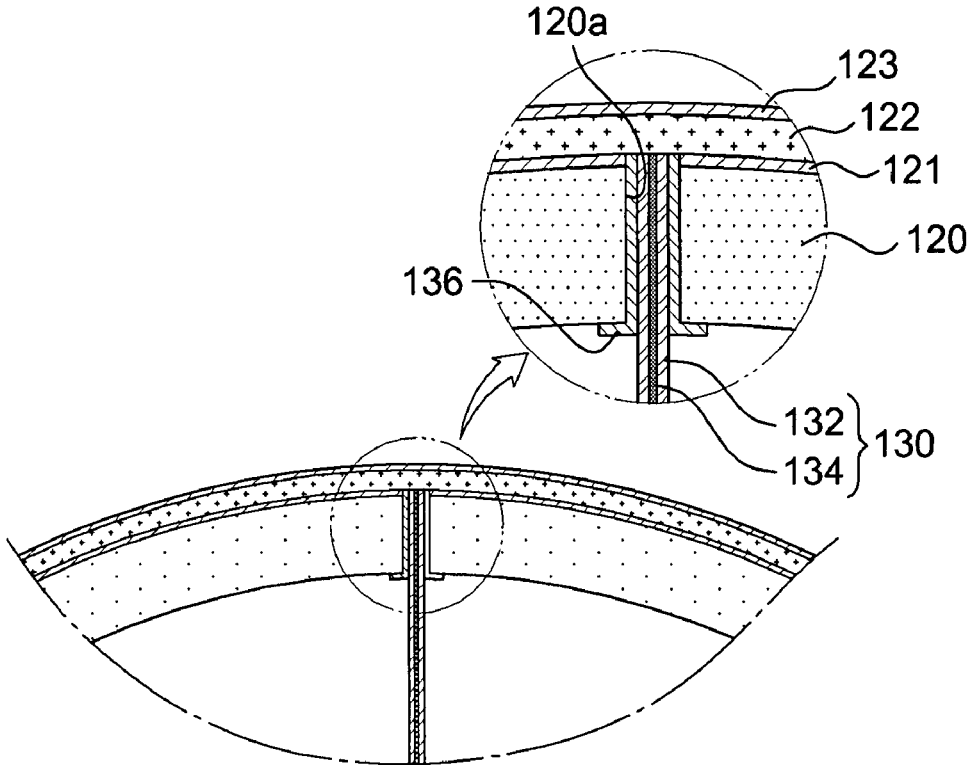

Afterwards, as shown in FIG. 17, an insulating film 123 of a dielectric material is formed on the circumference of each of the ring electrodes 122, thereby completing manufacture of the image forming element.

Image forming elements and manufacturing method in accordance with exemplary embodiments of the present invention may have one or more of the following advantages.

The structure and the manufacturing process steps can be simplified to reduce manufacturing costs by the image forming apparatus according to the present invention.

Particularly, since the plurality of ring electrodes are electrically connected with the control device, which independently controls each of the ring electrodes, through the connecting member formed by the fine pitch, the structure of the image forming element and the whole manufacturing process steps can be simplified, and workability and productivity can be improved.

Furthermore, since the electrical connecting portions of the ring electrodes are reduced to simplify the structure and the manufacturing process steps of the image forming element can be simplified, it is advantageous for mass production and the manufacturing cost is reduced to reduce the product cost.

Furthermore, the connecting member electrically connected with the ring electrodes can appropriately be arranged regardless of its peripheral structure.

Finally, since the connecting member can be arranged inside the image drum in a winding state or a bent state and the packaging space can be obtained efficiently, space utility of the image forming element can be improved and the small sized image forming element can be obtained.

Although the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. An image forming element comprising:

an image drum comprising a plurality of ring electrodes and a slot, wherein the plurality of ring electrodes are formed to be spaced apart from one another on a circumference of the image drum and the slot is formed in a longitudinal direction on the image drum; and a connecting member comprising a plurality of connecting electrodes and arranged inside the image drum with each of the plurality of connecting electrodes protruding into the slot and electrically connecting with the ring electrodes one to one on the same line, wherein the connecting member is formed of a flexible material, and wherein the connecting member is wound inside the image drum.

2. The image forming element of claim 1, wherein the connecting member comprises an insulating sheet with one end thereof protruding into the slot, the connecting electrodes are formed on one surface of the insulating sheet, and each of the connecting electrodes is spaced apart from one another.

3. The image forming element of claim 2, wherein the connecting electrodes are arranged at about a same interval as that of the ring electrodes.

4. The image forming element of claim 1, further comprising:

a clamp member interposed between the connecting member and the slot to fix the connecting member.

5. The image forming element of claim 1, wherein the image drum further comprises an insulating film formed on a circumference of the ring electrodes.

6. The image forming element of claim 1, wherein the connecting member comprises a control device configured to electrically control each of the ring electrodes independently.

7. The image forming element of claim 1, further comprising:

a support member disposed inside the image drum to support the connecting member.

8. The image forming element of claim 1, further comprising:

a rigid circuit board electrically connected to the connecting member, wherein a control device for electrical control of each of the ring electrodes is disposed at any one of the connecting member and the rigid circuit board.

9. The image forming element of claim 8, wherein the rigid circuit board is disposed inside the image drum.

10. The image forming element of claim 1, wherein a plurality of connecting members is provided, and the plurality of connecting electrodes of each connecting member protrudes into the slot such that the connecting electrodes formed in any one of the connecting members are in surface contact with other connecting electrodes formed in another one of the connecting members.

11. An image forming element comprising:

an image drum comprising a plurality of ring electrodes and a slot, wherein the plurality of ring electrodes are formed to be spaced apart from one another on a circumference of the image drum and the slot is formed in a longitudinal direction on the image drum; and a flexible printed circuit board (FPCB) comprising a plurality of connecting electrodes of fine patterns and disposed inside the image drum with each of the plurality of connecting electrodes protruding into the slot and electrically connecting with the ring electrodes one to one on the same line, wherein the FPCB is wound inside the image drum.

12. The image forming element of claim 11, further comprising:

a clamp member interposed between the FPCB and the slot to fix the FPCB.

13. The image forming element of claim 11, wherein the image drum further comprises an insulating film formed on a circumference of the ring electrodes.

14. The image forming element of claim 11, wherein the FPCB comprises a control device configured to electrically control each of the ring electrodes independently.

15. The image forming element of claim 11, further comprising:

a support member disposed inside the image drum to support the FPCB.

16. The image forming element of claim 11, further comprising:

a rigid circuit board electrically connected to the flexible printed circuit board, wherein a control device for individual electrical control of each of the ring electrodes is provided by at least one of the FPCB and the rigid circuit board.

17. The image forming element of claim 16, wherein the rigid circuit board is disposed inside the image drum.

18. A method of manufacturing an image forming element, the method comprising:

providing an image drum and a connecting member, wherein the image drum comprises a slot formed in a longitudinal direction and the connecting member comprises a plurality of connecting electrodes spaced apart from one another on the same plane and electrically insulated from one another;

disposing the connecting member inside the image drum so that each connecting electrode protrudes into the slot and is externally exposed from the image drum; and forming a plurality of ring electrodes on a circumference of the image drum to correspond to the respective connecting electrodes one to one and electrically connect with the connecting electrodes, wherein the connecting member is formed of a flexible material, and wherein the connecting member is disposed inside the image drum in a winding state.

19. The method of claim 18, wherein the connecting electrodes are arranged at about a same interval as that of the ring electrodes.

20. The method of claim 18, wherein the connecting member is a flexible printed circuit board (FPCB).

21. The method of claim 18, wherein the connecting member is received in the slot so that one end of each connecting electrode is arranged on about the same circumference as that of the image drum.

22. The method of claim 18, further comprising:

forming an insulating film on a circumference of the ring electrodes.

23. The method of claim 18, further comprising:

providing a clamp member interposed between the connecting member and the slot to fix the connecting member.

24. The method of claim 18, wherein the connecting member comprises a control device configured to electrically control each of the ring electrodes individually.

25. The method of claim 18, further comprising:

providing a support member inside the image drum to support the connecting member.

26. The method of claim 18, further comprising:

providing a rigid circuit board electrically connected to the connecting member, wherein a control device for electrical control of each of the ring electrodes is provided by at least one of the connecting member and the rigid circuit board.

27. The method of claim 26, wherein the rigid circuit board is disposed inside the image drum.

28. The method of claim 18, wherein a plurality of connecting members is provided, and one end of each connecting member is received in the slot in a state in which the one end of each connecting member is in surface contact with another end of each connecting member.

29. The image forming element of claim 2, wherein the connecting electrodes are formed on one surface of the insulating sheet such that at least one side of the connecting electrodes is externally exposed from a side of the insulating sheet.

30. The image forming element of claim 2, wherein the insulating sheet comprises a plurality of insulating sheet layers overlapped with one another, and wherein each connecting electrode is arranged between the respective insulating sheet layers.

31. The image forming element of claim 1, wherein the plurality of connecting electrodes are spaced apart from one another at a period of about 2 μm to about 85 μm.

32. The image forming element of claim 1, wherein the plurality of connecting electrodes are spaced apart from one another at a period of about 42.3 μm.

* * * * *